US009976103B2

(12) United States Patent
Yodice et al.

(10) Patent No.: US 9,976,103 B2
(45) Date of Patent: May 22, 2018

(54) LUBRICATING COMPOSITION CONTAINING AN ANTIWEAR AGENT

(75) Inventors: Richard Yodice, Mentor, OH (US); Seth L. Crawley, Mentor, OH (US); Jody A. Kocsis, Chagrin Falls, OH (US)

(73) Assignee: THE LUBRIZOL CORPORATION, Wickliffe, OH (US)

( * ) Notice: Subject to any disclaimer, the term of this patent is extended or adjusted under 35 U.S.C. 154(b) by 367 days.

(21) Appl. No.: 13/515,341

(22) PCT Filed: Dec. 10, 2010

(86) PCT No.: PCT/US2010/059802

§ 371 (c)(1), (2), (4) Date: Sep. 24, 2012

(87) PCT Pub. No.: WO2011/081835

PCT Pub. Date: Jul. 7, 2011

(65) Prior Publication Data

US 2013/0172221 A1 Jul. 4, 2013

Related U.S. Application Data

(60) Provisional application No. 61/286,105, filed on Dec. 14, 2009.

(51) Int. Cl.

| | |
|---|---|
| ***C10M 133/24*** | (2006.01) |
| ***C10M 133/06*** | (2006.01) |
| ***C10M 133/22*** | (2006.01) |
| ***C10M 135/12*** | (2006.01) |
| ***C10M 159/12*** | (2006.01) |

(52) U.S. Cl.

CPC ..... *C10M 133/24* (2013.01); *C10M 133/06* (2013.01); *C10M 133/22* (2013.01); *C10M 135/12* (2013.01); *C10M 159/12* (2013.01); *C10M 2207/028* (2013.01); *C10M 2207/042* (2013.01); *C10M 2207/26* (2013.01); *C10M 2207/262* (2013.01); *C10M 2207/289* (2013.01); *C10M 2215/04* (2013.01); *C10M 2215/086* (2013.01); *C10M 2215/16* (2013.01); *C10M 2215/223* (2013.01); *C10M 2219/046* (2013.01); *C10M 2219/089* (2013.01); *C10M 2223/043* (2013.01); *C10M 2223/045* (2013.01); *C10N 2230/06* (2013.01); *C10N 2230/42* (2013.01); *C10N 2230/43* (2013.01); *C10N 2230/45* (2013.01); *C10N 2240/10* (2013.01)

(58) Field of Classification Search

CPC ..... C10M 133/06; C10M 133/22; C10M 133/24; C10M 135/12; C10M 139/12; C10M 2207/042; C10M 2007/26; C10M 2207/262; C10M 2207/289; C10M 2215/04; C10M 2215/086; C10M 2215/16; C10M 2215/223; C10M 2219/046; C10M 2219/089; C10M 223/043; C10M 223/045; C10N 2230/06; C10N 2230/42; C10N 2230/43; C10N 2230/45; C10N 2240/10

USPC ..... 508/280

See application file for complete search history.

(56) References Cited

U.S. PATENT DOCUMENTS

| | | | | |
|---|---|---|---|---|
| 3,127,349 | A | 3/1964 | Rockett | |
| 3,366,569 | A | 1/1968 | Norman et al. | |
| 3,463,804 | A | 8/1969 | Ray et al. | |
| 3,896,050 | A | 7/1975 | White | |
| 4,012,408 | A | 3/1977 | White | |
| 4,025,446 | A | 4/1977 | Cier et al. | |
| 4,031,015 | A | 6/1977 | Miller | |
| 4,058,469 | A * | 11/1977 | Hoke | 508/447 |
| 4,209,408 | A * | 6/1980 | Hoke | C10M 135/22 508/272 |
| 5,430,177 | A | 7/1995 | Sabahi et al. | |
| 2004/0235682 | A1* | 11/2004 | Van Dam | C10M 163/00 508/192 |
| 2005/0184466 | A1* | 8/2005 | Yoshida et al. | 277/468 |
| 2006/0189489 | A1 | 8/2006 | Fujitsu et al. | |
| 2006/0193652 | A1 | 8/2006 | Fujitsu et al. | |
| 2008/0146473 | A1* | 6/2008 | Van Leeuwen et al. | 508/287 |

FOREIGN PATENT DOCUMENTS

| | | |
|---|---|---|
| FR | 1258718 | 4/1961 |
| GB | 1538889 | 1/1979 |
| WO | 2010033447 | 3/2010 |

OTHER PUBLICATIONS

Avram et al., Romanian Journal publication "Revista de Chimie", (Bucharest, Romania) (1981) 32(7), pp. 686-687, also available as CAS Abstract document No. 96:165183.

Corresponding PCT Publication No. WO2011/081835 A1 and Search Report dated Jul. 7, 2011.

Written Opinion from corresponding International Application No. PCT/US2010/059802 dated Mar. 7, 2011.

Gololobov et al., "2-Cycanoacrylates as Reagents in Heteroatomic Synthesis", "Heteroatom Chemistry", vol. 6. No. 3, 1995 , pp. 271-280.

* cited by examiner

*Primary Examiner* — James Goloboy

(74) *Attorney, Agent, or Firm* — Iken S. Sans; Teresan W. Gilbert

(57) ABSTRACT

The invention provides a lubricating composition containing an oil of lubricating viscosity and a nitrile compound. The invention further relates to a method of the lubricating an internal combustion engine with the lubricating composition.

8 Claims, No Drawings

LUBRICATING COMPOSITION CONTAINING AN ANTIWEAR AGENT

FIELD OF INVENTION

The invention provides a lubricating composition containing an antiwear agent and an oil of lubricating viscosity. The invention further relates to the use of the lubricating composition in an internal combustion engine.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and lead and copper corrosion. Consequently, engine lubricants may also contain a friction modifier to obviate the detrimental impact of ZDDP on fuel economy and corrosion inhibitors to obviate the detrimental impact of ZDDP on lead and copper corrosion. Other additives may also increase lead corrosion.

Further, engine lubricants containing phosphorus compounds and sulphur have been shown to contribute in part to particulate emissions and emissions of other pollutants. In addition, sulphur and phosphorus tend to poison the catalysts used in catalytic converters, resulting in a reduction in performance of said catalysts.

With increasing control of both the formation of sulphated ash and release of emissions (typically to reduce NOx formation, SOx formation) there is a desire towards reduced amounts of sulphur, phosphorus and sulphated ash in engine oils. Consequently, the amounts of phosphorus-containing antiwear agents such as ZDDP, overbased detergents such as calcium or magnesium sulphonates and phenates have been reduced. As a consequence, ashless additives such as esters of polyhydric alcohols or hydroxyl containing acids including glycerol monooleate and alkoxylated amines have been contemplated to provide friction performance. However there have been observations that ashless friction modifiers may in some instances increase corrosion of metal, namely, copper or lead. Copper and lead corrosion may be from bearings and other metal engine components derived from alloys using copper or lead. Consequently, there is a need to reduce the amount of corrosion caused by ashless additives. However, reducing the levels of antiwear and other ash-containing additives may result in increasing amounts of wear and/or corrosion (lead and copper).

U.S. Pat. No. 3,127,349 discloses a composition optionally containing a nitrile ester capable of increasing the viscosity index of an oil containing a viscosity index improver and attenuating viscosity index decrease over time.

U.S. Pat. No. 3,366,569 discloses a composition resulting from contacting an alkylene polyamine with a hydrocarbyl substituted acylating agent and a nitrile such as acrylonitrile. The composition provides detergency and rust protection.

U.S. Pat. No. 4,025,446 discloses the use of several poly-nitrile compounds as effective anti-wear agents.

U.S. Pat. No. 4,209,408 discloses a lubricating composition containing at least one polyfunctional sulphur-containing nitrile.

U.S. Pat. Nos. 4,012,408 and 3,896,050 disclose a copper corrosion inhibitor derived from a cyano-substituted isothiazole.

U.S. Pat. No. 4,031,015 discloses oil-soluble compositions containing the reaction product of an olefin with an α,β-unsaturated nitrile to form an organonitrile. The organonitrile is then reacted with an amine or polyamine.

British Patent GB 1 538 889 discloses a lubricating composition containing a nitrile compound having either (i) an aliphatic thioether group, or (ii) an aliphatic ether group.

U.S. Pat. No. 4,058,469 discloses the use of polyfunctional nitriles as effective seal swelling agents and demulsifiers.

US Patent Application 2006/0189489 A1 discloses a lubricating composition containing base oil, glycerol monooleate, and one or more nitriles.

US Patent Application 2006/183652 discloses a lubricating composition containing base oil, oleylamide, an ether and at least one nitrile.

Romanian journal publication Revistade Chimie (Bucharest, Romania) (1981), 32(7), 686-7 discloses motor oil containing 0.5 wt % to 1 wt % of four nitriles as corrosion inhibitors, extreme pressure agents or antiwear agents. The nitriles include dodecylnitrile, stearylnitrile, oleylnitrile, and mixed-nitrile derivatives of linseed oil.

SUMMARY OF THE INVENTION

The inventors of this invention have discovered a lubricating composition that is capable of providing at least one of antiwear performance, friction modification (particularly for enhancing fuel economy), extreme pressure performance, or lead or copper corrosion inhibition. In one embodiment the invention is capable of providing lead or copper corrosion inhibition (typically lead corrosion inhibition).

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

In one embodiment the present invention provides a lubricating composition comprising an oil of lubricating viscosity and a nitrile compound obtained/obtainable by a process comprising:

Step (1) reacting:

(i) a carbonyl-containing compound (typically a ketone or aldehyde), with (ii) a compound represented by the formula $N{\equiv}C{-}CH_2{-}T$, wherein T may be an electron withdrawing group, for instance $-C{\equiv}N$, $-CO_2R^1$, or $-C(O)NR^2R^3$, $-C(O)SR^4$, typically T may be $-C{\equiv}N$;

$R^1$ may be a hydrocarbyl group, typically containing 1 to 30, or 4 to 20 carbon atoms;

$R^2$ may be hydrogen or a hydrocarbyl group, typically containing 1 to 30, or 4 to 20 carbon atoms;

$R^3$ may be hydrogen or a hydrocarbyl group (typically containing 1 to 30, or 4 to 20 carbon atoms) or hydrogen;

$R^4$ may be hydrogen or a hydrocarbyl group (typically containing 1 to 30, or 4 to 20 carbon atoms) or hydrogen; and Step (2) reacting the product of step (1) with a compound having an abstractable proton (typically a thiol, a primary or secondary amine, or a nitrogen containing heterocylic compound (such as (a tetrazole, a pyrrole, a pyrrolidine, a pyrrolidinone, a pyridine, an aminopyridine, a piperidine, a pyrazole, a pyrazine, pyridazine, a 1,2,4-triazole, a benzotriazole, a quinoline, an indole, an imidazole)), or with a hydrocarbyl halide. Typically step (2) may involve reacting the product of step (1) with a thiol, a tetrazole (such as an aminotetrazole), a 1,2,4-triazole or a benzotriazole (such as tolyltriazole) or an aminotriazole.

In one embodiment the compound having an abstractable proton may be a thiol or a primary or secondary amine, typically a thiol.

In one embodiment the invention provides a lubricating composition comprising an oil of lubricating viscosity and a product obtained/obtainable by a process comprising:

Step (1) reacting:

(i) a carbonyl-containing compound (typically a ketone or aldehyde), with (ii) a compound represented by the formula N≡C—$CH_2$-T, to form a compound of formula (1):

formula (1)

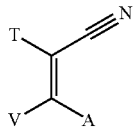

and

Step (2) reacting the compound of formula (1) with a thiol or amine to form a compound of formula (2), formula (3), formula (4), formula (5), or mixtures thereof:

formula (2)

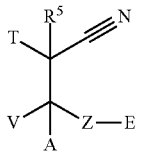

or formula (3)

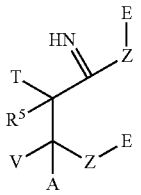

or formula (4)

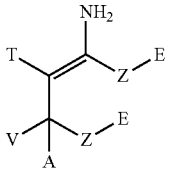

or

-continued formula (5)

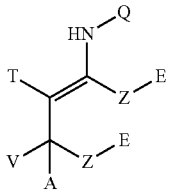

wherein

T may be an electron withdrawing group, for instance —C≡N, —$CO_2R^1$, or

—C(O)$NR^2R^3$, —C(O)$SR^4$, —C(S)$R^2R^3$, typically T may be —C≡N;

$R^1$ may be a hydrocarbyl group, typically containing 1 to 30, or 4 to 20 carbon atoms;

$R^2$ may be hydrogen, or a hydrocarbyl group, typically containing 1 to 30, or 4 to 20 carbon atoms;

$R^3$ may be hydrogen or a hydrocarbyl group (typically containing 1 to 30, or 4 to 20 carbon atoms);

$R^4$ may be hydrogen or a hydrocarbyl group (typically containing 1 to 30, or 4 to 20 carbon atoms);

$R^5$ may be hydrogen, or a hydrocarbyl group typically containing 1 to 10, or 1 to 5, or 1 to 2 carbon atoms (typically $R^5$ may be hydrogen);

V may be a hydrocarbyl group or hydrogen, or an aromatic group (such as a phenyl, benzyl, or naphthyl group). Typically V may be a hydrocarbyl group containing 1 to 30, or 4 to 20 carbon atoms; and A may be a hydrocarbyl group (typically containing 1 to 30, or 4 to 20 carbon atoms) or hydrogen, typically hydrogen;

Z may be —S— or >$NR^4$;

$R^4$ may be hydrogen or a hydrocarbyl group (typically containing 1 to 30, or 4 to 20 carbon atoms), typically $R^4$ may be hydrogen;

E may be a hydrocarbyl group (typically containing 4 to 50, or 4 to 20, or 6 to 12 carbon atoms. The hydrocarbyl group may include alicyclic or cyclic groups (for instance, E may be an alkyl, an aromatic or a heterocyclic group), or a difunctional group; and Q may be either an acyl group such as C(O)$CH_3$, or a hydrocarbyl group, typically containing 1 to 20 carbon atoms, or a benzyl group. The hydrocarbyl group may include alicyclic or cyclic groups (for instance, Q may be an alkyl, an aromatic, or a heterocyclic group) or a difunctional group.

In one embodiment, when Z is —S—, and T is —C(O)$NR^2R^3$, $_V$ is a hydrocarbyl group containing 1 to 5, or 1 to 4 carbon atoms.

Typically $R^5$ may be hydrogen when the compound of formula (1) is reacted with a thiol.

$R^5$ may be the hydrocarbyl group as defined above when a compound of formula (2) is further reacted with a base (such as triethylamine) followed by alkylation with a $C_{1-10}$-alkylhalide (such as an alkyl iodide), wherein the number of carbon atoms defined for $R^5$ is the same as the number of carbon atoms of the alkyl halide.

The difunctional group may be an alkylene group (typically containing 1 to 20, or 1 to 10, or 1 to 5, or 1 to 3 carbon atoms. Examples of a alkylene bridging group include methylene, ethylene, propylene, butylene or pentylene), or a benzene 1,4-diamino group such as:

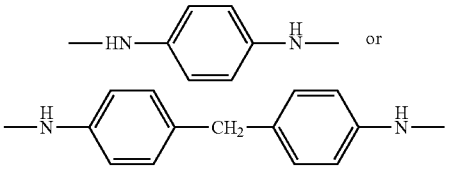

In one embodiment the compound of formula (2) and/or (3) may have a bis-structure represented by formula (2a) and (3a):

formula (2a)

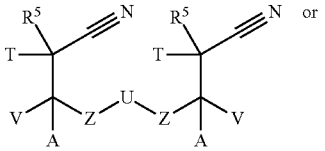

formula (3a)

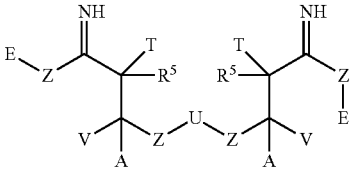

wherein E, Z, T, $R^5$, and Z are the same as defined above, and U may be a difunctional group as described previously within the definition of E.

The compounds of formulae (2a) and/or (3a) may be derived by reacting in step (3) the product of step (2) with a diamino- or dithio-compound, such as 1,2-ethanedithiol, 1,3-propanedithiol, 1,4-butanedithiol, 1,2-diaminoethane, phenylene-diamine, 1,4-diaminobutane, or 1,3-diaminopropane or dimercaptothiadiazole.

In one embodiment the invention provides a lubricating composition comprising an oil of lubricating viscosity and at least one compound of formula (2) to formula (5), or mixtures thereof:

formula (2)

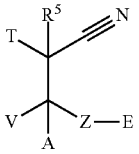

formula (3)

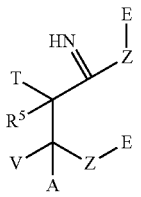

formula (4)

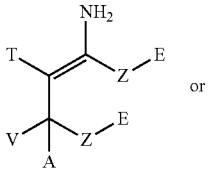

-continued formula (5)

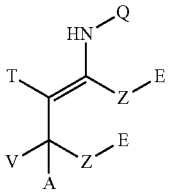

wherein

T may be an electron withdrawing group, for instance —C≡N, —$CO_2R^1$, or

—C(O)$NR^2R^3$, —C(O)$SR^4$, —C(S)$R^2R^3$, typically T may be —C≡N;

$R^1$ may be a hydrocarbyl group, typically containing 1 to 30, or 4 to 20 carbon atoms;

$R^2$ may be hydrogen, or a hydrocarbyl group, typically containing 1 to 30, or 4 to 20 carbon atoms;

$R^3$ may be hydrogen or a hydrocarbyl group (typically containing 1 to 30, or 4 to 20 carbon atoms);

$R^4$ may be hydrogen or a hydrocarbyl group (typically containing 1 to 30, or 4 to 20 carbon atoms);

$R^5$ may be hydrogen, or a hydrocarbyl group typically containing 1 to 10, or 1 to 5, or 1 to 2 carbon atoms (typically $R^5$ may be hydrogen);

V may be a hydrocarbyl group or hydrogen, or an aromatic group (such as a phenyl, benzyl, or napththyl group). Typically V may be a hydrocarbyl group containing 1 to 30, or 4 to 20 carbon atoms; and A may be a hydrocarbyl group (typically containing 1 to 30, or 4 to 20 carbon atoms) or hydrogen, typically hydrogen;

Z may be —S— or >$NR^4$;

$R^4$ may be hydrogen or a hydrocarbyl group (typically containing 1 to 30, or 4 to 20 carbon atoms), typically $R^4$ may be hydrogen;

E may be a hydrocarbyl group (typically containing 4 to 50, or 4 to 20, or 6 to 12 carbon atoms. The hydrocarbyl group may include alicyclic or cyclic groups (for instance, E may be an alkyl, an aromatic or a heterocyclic group), or a difunctional group; and Q may be either an acyl group such as C(O)$CH_3$, or a hydrocarbyl group, typically containing 1 to 20 carbon atoms, or a benzyl group. The hydrocarbyl group may include alicyclic or cyclic groups (for instance, Q may be an alkyl, an aromatic, or a heterocyclic group) or a difunctional group.

In one embodiment the invention provides a lubricating composition comprising an oil of lubricating viscosity and a compound of formula (2) to formula (3), or mixtures thereof:

formula (2)

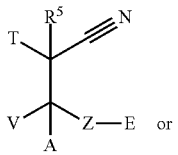

-continued formula (3)

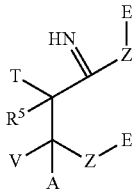

wherein

T may be an electron withdrawing group, for instance —C≡N, —$CO_2R^1$, or

—C(O)$NR^2R^3$, —C(O)$SR^4$, typically T may be —C≡N;

$R^1$ may be a hydrocarbyl group, typically containing 1 to 30, or 4 to 20 carbon atoms;

$R^2$ may be hydrogen, or a hydrocarbyl group, typically containing 1 to 30, or 4 to 20 carbon atoms;

$R^3$ may be hydrogen or a hydrocarbyl group (typically containing 1 to 30, or 4 to 20 carbon atoms);

$R^4$ may be hydrogen or a hydrocarbyl group (typically containing 1 to 30, or 4 to 20 carbon atoms);

$R^5$ may be hydrogen, or a hydrocarbyl group typically containing 1 to 10, or 1 to 5, or 1 to 2 carbon atoms (typically $R^5$ may be hydrogen);

V may be a hydrocarbyl group or hydrogen, typically a hydrocarbyl group containing 1 to 30, or 4 to 20 carbon atoms; and A may be a hydrocarbyl group (typically containing 1 to 30, or 4 to 20 carbon atoms) or hydrogen, typically hydrogen;

Z may be —S— or >$NR^4$;

$R^4$ may be hydrogen or a hydrocarbyl group (typically containing 1 to 30, or 4 to 20 carbon atoms), typically $R^4$ may be hydrogen; and E may be a hydrocarbyl group, typically containing 4 to 50, or 4 to 20, or 6 to 12 carbon atoms.

In one embodiment the invention provides a lubricating composition wherein the nitrile compound may be present at 0.001 wt % to 5 wt %, or 0.005 wt % to 2.5 wt %, or 0.01 wt % to 2 wt %, or 0.05 wt % to 0.5 wt %, or 0.05 wt % to 0.1 wt % of the lubricating composition.

In one embodiment the invention provides a lubricating composition comprising the nitrile compound disclosed herein and an alkylated diphenylamine. The alkylated diphenylamine may include bis-nonylated diphenylamine, nonyl diphenylamine, octyl diphenylamine, bis-octylated diphenylamine, bis-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl diphenylamine or dinonyl diphenylamine.

When present, the alkylated diphenylamine may be present at 0.05 wt % to 5 wt %, or 0.1 wt % to 3 wt %, or 0.5 wt % to 2 wt % of the lubricating composition.

In one embodiment the invention provides a lubricating composition wherein the nitrile compound disclosed herein may be present at 0.01 wt % to 2 wt % (or typically 0.05 wt % to 0.5) wt % and the alkylated diphenylamine may be present at 0.1 wt % to 3 wt % (or typically 0.5 wt % to 2 wt %) of the lubricating composition.

In one embodiment the invention provides a method of lubricating an internal combustion engine comprising supplying to the internal combustion engine a lubricating composition as disclosed herein.

In one embodiment the invention provides for the use of the nitrile compound described herein in a lubricant as an antioxidant, an antiwear agent, friction modifier, extreme pressure agent, seal swell agent, or lead or copper (typically lead) corrosion inhibitor for an internal combustion engine.

In one embodiment the invention provides for the use of the nitrile compound disclosed herein in a lubricant as an antioxidant or a lead or copper (typically lead) corrosion inhibitor for an internal combustion engine.

DETAILED DESCRIPTION OF THE INVENTION

The present invention provides a lubricating composition, a method for lubricating an engine as disclosed above, and a use of the nitrile compounds as disclosed above.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Nitrile Compound

The nitrile compound described herein may be derived from a number of compounds derived from a compound represented by the formula N≡C—$CH_2$-T, wherein T may be —C≡N, —$CO_2R^1$, or —C(O)$NR^2R^3$, —C(O)$SR^4$, typically T may be —C≡N. When T is:

—C≡N, the compound is malononitrile;

—$CO_2R^1$, the compound is a hydrocarbyl-2-cyanoacetate, wherein the hydrocarbyl typically contains 1 to 30, or 4 to 20 carbon atoms;

—C(O)$NR^2R^3$, the compound is a 2-cyano-N,N-dihydrocarbylacetamide when both $R^2$ and $R^3$ are hydrocarbyl group typically containing 1 to 30, or 4 to 20 carbon atoms;

—C(O)$NR^2R^3$, the compound is a 2-cyano-N,N-hydrocarbylacetamide when one of $R^2$ and $R^3$ is hydrogen and the one of either $R^2$ and $R^3$ is a hydrocarbyl group typically containing 1 to 30, or 4 to 20 carbon atoms;

—C(O)$SR^4$, the compound is a S-hydrocarbyl-2-cyanoethanethioate when $R^4$ is a hydrocarbyl group typically containing 1 to 30, or 4 to 20 carbon atoms;

—C(O)$SR^4$, the compound is 2-cyanoethanethioic S-acid, when $R^4$ is hydrogen.

In one embodiment T may be —C≡N.

Examples of hydrocarbyl-2-cyanoacetate include butyl-2-cyanoacetate, hexyl-2-cyanoacetate, 2-ethylhexyl-2-cyanoacetate, octyl-2-cyanoacetate, nonyl-2-cyanoacetate, decyl-2-cyanoacetate, dodecyl-2-cyanoacetate, tridecyl-2-cyanoacetate, butadecyl-2-cyanoacetate, pentadecyl-2-cyanoacetate, hexadecyl-2-cyanoacetate, heptadecyl-2-cyanoacetate, octadecyl-2-cyanoacetate, nonadecyl-2-cyanoacetate, or eicosyl-2-cyanoacetate.

Examples of 2-cyano-N,N-dihydrocarbylacetamide include 2-cyano-N,N-dibutylacetamide, 2-cyano-N,N-dihexylacetamide, 2-cyano-N,N-di-(2-ethylhexyl)-acetamide, 2-cyano-N,N-dinonylacetamide, 2-cyano-N,N-didecylacetamide, 2-cyano-N,N-diundecylacetamide, 2-cyano-N,N-didodecylacetamide, 2-cyano-N,N-ditridecyl-acetamide, 2-cyano-N,N-dibutadecylacetamide, 2-cyano-N,N-dipentadecylacetamide, 2-cyano-N,N-dihexadecylacetamide, 2-cyano-N,N-diheptadecylacetamide, 2-cyano-N,N-dioctadecylacetamide, 2-cyano-N,N-dinonadecylylacetamide, or 2-cyano-N,N-dieicosylacetamide.

Examples of 2-cyano-N,N-hydrocarbylacetamide include 2-cyano-N,N-butylacetamide, 2-cyano-N,N-hexylacetamide, 2-cyano-N,N-(2-ethylhexyl)-acetamide, 2-cyano-N,N-nonylacetamide, 2-cyano-N,N-decylacetamide, 2-cyano-N,N-undecylacetamide, 2-cyano-N,N-dodecylacetamide, 2-cyano-N,N-tridecylacetamide, 2-cyano-N,N-butadecylacetamide, 2-cyano-N,N-pentadecylacetamide, 2-cyano-N,N-hexadecylacetamide, 2-cyano-N,N-heptadecylacetamide, 2-cyano-N,N-octadecyl-acetamide, 2-cyano-N,N-nonadecylylacetamide, or 2-cyano-N,N-eicosylacetamide.

Examples of S-hydrocarbyl-2-cyanoethanethioate include S-butyl-2-cyanoethanethioate, S-hexyl-2-cyanoethanethioate, S-(2-ethylhexyl)-2-cyanoethanethioate, S-octyl-2-cyanoethanethioate, S-nonyl-2-cyanoethanethioate, S-decyl-2-cyanoethanethioate, S-undecyl-2-cyanoethanethioate, S-dodecyl-2-cyanoethanethioate, S-tridecyl-2-cyanoethanethioate, S-butadecyl-2-cyanoethanethioate, 5-pentadecyl-2-cyanoethanethioate, S-hexadecyl-2-cyanoethanethioate, S-heptadecyl-2-cyanoethanethioate, S-octadecyl-2-cyanoethanethioate, S-nonadecyl-2-cyanoethanethioate, or S-eicosyl-2-cyanoethanethioate.

The carbonyl-containing compound may be a ketone or aldehyde. The carbonyl-containing compound may in addition to the carbonyl carbon contain a hydrocarbyl group containing 1 to 30, or 4 to 20 carbon atoms.

Examples of an aldehyde include methanal, ethanal, propanal, butanal, isobutyraldehyde, pentanal, hexanal, heptanal, octanal, 2-ethylhexanal, nonanal, decanal, undecanal, dodecanal, tridecanal, butadecanal, pentadecanal, hexadecanal, heptadecanal, octadecanal, nonadecanal, or eicosanal.

Examples of an aromatic aldehyde include benzaldehyde, or alkyl-substituted benzaldehydes such as 2-methyl benzaldehyde 3-methyl benzaldehyde, 4-methyl benzaldehyde, 2-ethyl benzaldehyde, 3-ethyl benzaldehyde, 4-ethyl benzaldehyde, o-methoxybenzaldehyde, p-methoxybenzaldehyde, m-methoxybenzaldehyde, o-nitrobenzaldehyde, p-nitrobenzaldehyde, m-nitrobenzaldehyde p-chlorobenzaldehyde, salicaldehyde, or mixtures thereof. In one embodiment the aromatic aldehyde may be benzaldehyde.

Examples of a ketone include acetone, acetophenone, cyclohexanone, methyl ethylketone, methyl propyl ketone, methyl isobutyl ketone, butan-2-one, pentan-2-one, pentan-3-one, hexane-2-one, hexan-3-one, heptan-2-one, heptan-3-one, heptan-4-one, or mixtures thereof.

The thiol may be represented by formula E(—SH)$_m$, wherein E is a group which may contain 4 to 50, or 4 to 20, or 6 to 12 carbon atoms, and wherein m may be 1 to 10, or 1 to 6, or 1 to 2, or 1. The thiol E group may be a hydrocarbyl group for example alk(en)yl, aryl, or alkaryl (typically alk(en)yl including alkyl). The hydrocarbyl group E may be linear or branched, typically linear. In one embodiment the thiol may be represented by formulae E(—SH)$_m$, wherein m=1 and E is a $C_{6-12}$ linear alkyl group.

The thiol may include nitro-, methoxy, chloro-, bromo-, or hydrocarbyl-substituted thiophenols, ethane dithiol, benzenethiol, butane-1-thiol, butane-2-thiol, pentane-1-thiol, pentane-2-thiol, hexane-1-thiol, hexane-2-thiol, heptane-1-thiol, heptane-2-thiol, octane-1-thiol, octane-2-thiol, nonane-1-thiol, nonane-2-thiol, nonane-3-thiol, nonane-5-thiol, decane-1-thiol, decane-2-thiol, decane-3-thiol, decane-4-thiol, decane-5-thiol, dodecane-1-thiol (may also be referred to as n-dodecylmercaptan), dodecane-2-thiol, t-nonyl mercaptan, or mixtures thereof.

The nitrile compound may be derived from the reaction described herein in the presence of an amine. The amine has at least one primary or secondary amino-group.

The amine may be a monoamine, a diamine, or a polyamine, or an aminoalcohol, typically a monoamine or an aminoalcohol. The amine may contain hydrocarbyl groups that may be alk(en)yl, aryl, or alkaryl. When the hydrocarbyl group contains an alk(en)yl group (or functional moiety) the carbon atoms may be linear or branched.

The monoamine may include a variety of amines having 4 to 30, or 6 to 20, or 8 to 18 carbon atoms. The monoamine may include butylamine, 2-methylpentamine, 2-propylheptamine, 2-butyloctamine, 2-ethylhexylamine, octylamine, nonylamine, isooctylamine, isononylamine, 2-tert-butylheptamine, decylamine, undecylamine, dodecylamine, 2-methyldodecylamine, tridecylamine, tetradecylamine, pentadecylamine, hexadecylamine, 2-methylhexa-decylamine, heptadecylamine, octadecylamine, nonadecylamine, eicosamine, cetyleicosylamine, stearyleicosylamine, docosylamine and/or triacontylamine. Other useful monoamines include oleyl amine, stearyl amine, coco amine, tallow amine, or mixtures thereof.

The primary amine may also include amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of a secondary amine include dimethylamine, diethylamine, dipropylamine, dibutylamine, diamylamine, dihexylamine, diheptylamine, methyl ethylamine, ethylbutyl amine, N-methyl-1-amino-cyclohexane, Armeen® 2C and ethylamylamine. The secondary amine may include cyclic amines such as piperidine, piperazine, morpholine, aminodiphenylamine, phenylene diamine, or methylene dianiline.

The aminoalcohol may include ethanolamine, isopropanolamine, diethanolamine, triethanolamine, diethyl ethanolamine, dimethylethanolamine, dibutylethanolamine, 3-amino-1,2-propanediol, serinol, 2-amino-2-methyl-1,3-propanediol, tris(hydroxymethyl)-aminomethane, N-methylglucamine, 1-amino-1-deoxy-D-sorbitol, diethanol amine, diisopropanolamine, N-methyl-N,N-diethanol amine, triethanolamine, N,N,N',N'-tetrakis(2-hydroxypropyl)ethylenediamine, 2-amino-2-methyl-1-propanol, 2-dimethylamino-methyl-1-propanediol, 2-amino-2-ethyl-1,3-propanediol, 2-amino-2-methyl-1,3-propanediol, 2-amino-1-butanol and mixtures thereof. In one embodiment the aminoalcohol may be ethanolamine, or diethanolamine.

The benzotriazole may have a hydrocarbyl substituent on at least one of the following ring positions 1- or 2- or 4- or 5- or 6- or 7-. The hydrocarbyl groups may contain 1 to 30, 1 to 15, or 1 to 7 carbon atoms. In one embodiment the benzotriazole may be tolyltriazole. In one embodiment hydrocarbyl benzotriazoles substituted at positions 4- or 5- or 6- or 7- can be further reacted with an aldehyde and a secondary amine and can be represented by the formulae:

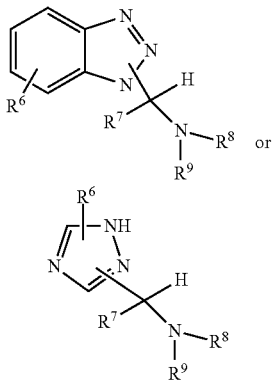

wherein the reaction product can form a carbon-nitrogen bond at ring position 1- or 2-, typically the carbon-nitrogen bond is at ring position 1-;

$R^6$ may be hydrogen or a hydrocarbyl group typically containing 1 to 30, or 1 to 15, or 1 to about 7 carbon atoms. In one embodiment $R^6$ may be hydrogen or methyl;

$R^7$ may be derived from the aldehyde of the reaction and may be hydrogen or a hydrocarbyl group (typically containing 1 to 7, or 1 to 4, or 1 to 2 carbon atoms). In one embodiment $R^7$ may be hydrogen. Examples of suitable aldehydes include formaldehyde, acetaldehyde (may also be in the form of a trimer known as metaldehyde), or propionaldehyde. In one embodiment the aldehyde may be formaldehyde, which can be monomeric, polymeric (paraformaldehyde) or in aqueous solution; often the formaldehyde is in aqueous solution;

$R^8$ and $R^9$ are derived from the amine of the reaction and are independently hydrogen or a hydrocarbyl group. Typically $R^8$ and $R^9$ are both hydrocarbyl groups. The hydrocarbyl group may contain 1 to 22, or 2 to 18, or 4 to 16, or 6 to 14 carbon atoms. Some examples of amines include dimethylamine, diethylamine, dipropylamine, dipropenylamine, diisobutylamine, diisobutenylamine, dip entylamine, dipentenylamine, dibenzylamine, dinaphthylamine, di-2-ethylhexylamine and mixtures thereof.

In step (1) the mole ratio of the carbonyl-containing compound to the compound represented by the formula N═C—$CH_2$-T may be in the range of 5:1 to 1:5, or 2:1 to 1:2, or 1:1.

The mole ratio of the product of step (1) to the compound having an abstractable proton may be 5:1 to 1:5, or 2:1 to 1:2, or 1:1 to 1:2.

The reaction to prepare the compound of the present invention may be performed under a variety of different reaction conditions. The reaction may be carried out at a reaction temperature in the range of 15° C. to 100° C., or 15° C. to 80° C., or 15° C. to 60° C. The reaction may be carried out in an inert atmosphere e.g., under nitrogen or argon, typically nitrogen. The reaction may be performed in the presence or absence of a solvent (typically including a solvent). The solvent may include an aromatic hydrocarbon solvent or alcohol such as ethanol, methanol, propanol, isopropanol, toluene (typically isopropanol). The reaction may be carried out in the absence or presence of catalyst (typically in the presence of a catalyst). Examples of the catalyst may include triethylamine, β-alanine, pyridine, piperidine, morpholine, piperazine, or ammonium chloride. In one embodiment the catalyst may be triethylamine or β-alanine.

Examples of an aromatic hydrocarbon solvent include Shellsolv AB® (commercially available from Shell Chemical Company); and toluene extract, xylene Aromatic 200, Aromatic 150, Aromatic 100, Solvesso 200, Solvesso 150, Solvesso 100, HAN 857® (all commercially available from Exxon Chemical Company), or mixtures thereof. Other aromatic hydrocarbon solvents include xylene, toluene, or mixtures thereof.

A lubricating composition may be prepared by adding the product of the process described herein to an oil of lubricating viscosity, optionally in the presence of other performance additives (as described herein below).

Other Performance Additives

The composition optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent, a dispersant viscosity modifier, a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The dispersant of the present invention may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be an N-substituted long chain alkenyl succinimide. An examples of a N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulphur containing phenates, sulphur containing phenates, sulphonates, salixarates, salicylates, and mixtures thereof.

The overbased detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased detergent may be a sodium, calcium or magnesium salt of a phenate, sulphur containing phenate, sulphonate, salixarate or salicylate. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. Overbased detergents are known in the art. The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at or 2 wt % to 3 wt % of the lubricating composition. For a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt %, or 0.1 wt % to 10 wt %, or 0.5 wt % to 5 wt % of the lubricating composition.

Antioxidants include sulphurised olefins, alkylated diphenylamines (as described previously), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition. The term "fatty" may refer to C8-C22 groups, typically straight-chain hydrocarbyl groups.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, fatty esters, or fatty epoxides; fatty alkyl tartrates; fatty alkyl tartrimides; and fatty alkyl tartramides. The friction modifier may be selected from fatty alkyl tartrates; fatty alkyl tartrimides; and fatty alkyl tartramides.

In one embodiment the friction modifier may be a long chain fatty acid ester. In another embodiment the long chain fatty acid ester may be a mono-ester and in another embodiment the long chain fatty acid ester may be a (tri)glyceride.

Other performance additives such as corrosion inhibitors include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including polysiloxanes or copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Nitrile Compound | 0.01 to 1.5 | 0.01 to 0.7 | 0.05 to 0.1 |
| Dispersant | 0.05 to 12 | 0.75 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 15 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |

-continued

| | Embodiments (wt %) | | |
|---|---|---|---|
| Additive | A | B | C |
| Any Other Performance Additive | 0 to 10 | 0 to 8 | 0 to 6 |
| Oil of Lubricating Viscosity | Balance to 100% | Balance to 100% | Balance to 100% |

INDUSTRIAL APPLICATION

The lubricating composition may be utilised in an internal combustion engine. The engine components may have a surface of steel or aluminium (typically a surface of steel).

An aluminium surface may be derived from an aluminium alloy that may be a eutectic or hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash content may be 0.05 wt % to 0.9 wt %, or 0.1 wt % to 0.2 wt % or to 0.45 wt %.

In one embodiment the lubricating composition may be an engine oil, wherein the lubricating composition may be characterised as having at least one of (i) a sulphur content of 0.5 wt % or less, (ii) a phosphorus content of 0.1 wt % or less, and (iii) a sulphated ash content of 1.5 wt % or less.

The following examples provide illustrations of the invention. These examples are non-exhaustive and are not intended to limit the scope of the invention.

EXAMPLES

Preparative Example 1 (EX1)

A 500 mL 2-neck round bottom flask equipped with a nitrogen inlet and thermocouple is charged with 38.9 parts by weight of 2-ethylhexanal, 200 parts by weight of ethanol, and 20 parts by weight of malononitrile. 0.1 parts by weight of triethylamine is added dropwise. The contents of the flask are stirred continuously. The reaction is stirred for 1 hour before solvent extraction under vacuum. The resultant product is believed to be 2-ethylhexanylidene malononitrile.

Preparative Example 2 (EX2)

A 500 mL 2-neck round bottom flask equipped with a nitrogen inlet and thermocouple is charged with 53 g of the product of EX1 and 61.4 g of n-dodecylthiol. 1 g of triethylamine is added resulting in the reaction temperature rising from 13° C. to 39.5° C. The reaction is allowed to cool before vacuum stripping of the product.

Preparative Example 3 (EX3)

A 500 mL 2-neck round bottom flask equipped with a nitrogen inlet and thermocouple is charged with 200 g of ethanol, and 53 g of benzaldehyde. 33 g of malononitrile and 10 mg of β-alanine are then added. The contents of the flask are stirred for 20 minutes. 50 g of 90% ethanol solution is then added to maintain the product in solvent whilst continuing to stir for an additional 3 hours. The product formed is then decanted into a one-liter reparatory funnel and extracted with toluene. The organic layers are washed twice with water, followed by saturated $NaHCO_3$, water and then brine. The organic layer is then dried with magnesium sulphate before solvent extraction under vacuum. The resultant product is then recrystallised from ethanol. The product is a white crystal.

Preparative Example 4 (EX4)

A one-liter round bottom flask equipped with a nitrogen inlet, thermocouple and dropping funnel is charged with 59.3 g of the product of EX1, 250 g of toluene, and 50 g of tetrahydrofuran. A pale yellow solution forms. To the pale yellow solution 500 mg of triethylamine is added followed by dropwise addition of 77.8 g of n-dodecylmercaptan over 15 minutes. The contents of the flask are stirred for 1 hour before solvent extraction under vacuum.

Preparative Example 5 (EX5)

A one-liter round bottom flask equipped with a nitrogen inlet, thermocouple and dropping funnel is charged with 100 g of isopropanol, 72 g of isobutyraldehyde and 66 g of malononitrile. Whilst stirring 1 g of triethylamine is added. The contents of the flask are stirred for 75 minutes. 202 g of dodecylmercaptan is added dropwise over a period of 2 hour 50 minutes. The resultant product is then vacuum stripped to remove solvent.

Preparative Example 6 (EX6)

A two-liter 4-necked round bottom flask equipped with a nitrogen inlet, thermocouple and dropping funnel is charged with 150 g of toluene, 176 g of the product of EX1. 1 g of triethylamine is then added followed by dropwise addition of 404 g of n-dodecylmercaptan over a period of 15 minutes. The contents of the flask are stirred for 1 hour before solvent extraction (i.e., removal) under vacuum.

Preparative Example 7 (EX7)

A one liter 4-necked round bottom flask equipped with a nitrogen inlet, thermocouple, and dropping funnel is charged with 77.3 g methyl cyanoacetate, 100 g 2-ethylhexanal, 200 g isopropanol, and 1 g triethylamine. The reaction is stirred at room temperature for 2 h. 157.9 g of n-dodecylmercaptan is added dropwise via addition funnel over 30 minutes. The contents of the flask are stirred for 4 hours before solvent extraction under vacuum.

Preparative Example 8 (EX8)

A one liter 4-necked round bottom flask equipped with a nitrogen inlet, thermocouple, and dropping funnel is charged with 100 g methyl cyanoacetate, 72.8 g isobutyraldehyde, 100 g toluene, and 1 g triethylamine. The reaction is stirred at room temperature for 2 hours, then 202.1 g n-dodecylmercaptan is added dropwise via addition funnel over 30 minutes. The contents of the flask are stirred for 4 hours before solvent extraction under vacuum.

Preparative Example 9 (EX9)

In a one liter 4-necked round bottom flask equipped with a nitrogen inlet, thermocouple, charged with 150 g of ethanol, 71.5 g. of the product of EX1 and 66.1 g of tolyltriazole. 200 mg of triethylamine is added. The temperature decreases as tolyltriazole dissolves. The contents of the flask are stirred at ambient temperature for 2 hours before adding 101.1 g of n-dodecylmercaptan. A 6° C. exotherm is observed. The contents of the flask are stirred at room temperature for 2 hours before solvent extraction under vacuum.

Preparative Example 10 (EX10)

In a one liter 4-necked round bottom flask equipped with a nitrogen inlet, thermocouple, is charged with 200 g of ethanol, 88.0 g of the product of EX1 and 34.5 g of 1,2,4-triazole. 200 mg of triethylamine is added. The temperature decreases as tolyltriazole dissolves. The contents of the flask are stirred at ambient temperature for 90 minutes before the addition of 101.1 g of n-dodecylmercaptan. The reaction has a 6° C. exotherm. The contents of the flask are stirred at room temperature for 2 hours before solvent extraction under vacuum.

Preparative Example 11 (EX11)

In a 1 liter, 4-necked round bottom flask equipped with a nitrogen inlet, thermocouple, is charged with 200 g of ethanol, 50.0 g of 2-methylpentanal, and 33.0 g of malononitrile. Then 200 mg of triethylamine is added. A 15° C. exotherm is observed. The contents of the flask is stirred at ambient temperature for 1 hour before adding 3-amino-1,2,4-triazole and 50 g of triethylamine. An exotherm of 10° C. is observed. The contents of the flask are stirred for 1 hour before the addition of 101.1 g of dodecylmercaptan. The reaction has a 6° C. exotherm. The contents of the flask are stirred at room temperature for 1 hour before solvent extraction under vacuum.

Preparative Example 12 (EX12)

In a one liter 4-necked round bottom flask equipped with a nitrogen inlet, thermocouple, is charged with 200 g of isopropanol, 88.0 g of the product of EX1 and 202.2 g of n-dodecylmercaptan over 10 minutes followed by the addition of 200 mg of triethylamine. A 10° C. exotherm is observed. The contents of the flask are stirred at ambient temperature for 1 hour before adding 50.0 g of triethylamine. Then the flask is charged with 51 g of acetic anhydride over 15 minutes. The contents of the flask are stirred at ambient temperature for 2 hours. The solvent is removed under vacuum and the product is dissolved in toluene. The toluene is then extracted with 100 g. of water (water is added twice more to remove impurities). The toluene layer is dried over magnesium sulphate, filtered and the solvent is removed in vacuum.

A series of SAE 15W-40 heavy duty diesel engine lubricants (IVL1 to IVL4) are prepared containing antioxidants (mixture hindered phenols and alkylated diphenylamines), 1.09 wt % of zinc dialkyldithiophosphate, a mixture of detergents (including calcium sulphonate and calcium phenate), a succinimide dispersant, 0.2 wt % of 2-tert-nonyldithio-5-mercapto-1,3,4-thiadiazole and further containing 0.1 wt % of the product obtained in EX2, EX4, EX5 or EX6 respectively.

Comparative Example 1 (CE1) is a SAE 15W-40 engine lubricant similar to INVL1, except it does not contain a nitrile compound of the present invention.

IVL1 to IVL4 and CE1 are then evaluated for performance by the methodology of ASTM Methods D6594-08 (test method covers testing diesel engine lubricants to determine their tendency to corrode various metals, specifically alloys of lead and copper commonly used in cam followers and bearings) and D130-04e1 (copper corrosion strip test).

The lubricants are also evaluated by in a High Temperature Cummins Bench Test (HTCBT) (a test carried out on lubricants to determine their tendency to corrode various metals, in particular lead and copper). Four metal samples of copper, lead, tin and phosphor bronze are immersed in 100 ml of oil and heated to 135° C. for 168, 240 and 336 hours with 5 liters of air per hour purging the sample. Typically better results are obtained for samples producing lower ppm quantities of lead.

| | CE1 | IVL1 |
|---|---|---|
| D6594-08 Copper (ppm) | 10 | 10 |
| D130 | 4C | 1B |
| HTCBT | | |
| Pb ppm (168 hr) | 66 | 29 |
| Pb ppm (240 hr) | 82 | 31 |
| Pb ppm (336 hr) | 81 | 34 |

The data presented indicates that the lubricating composition of the invention (for example, a heavy duty diesel internal combustion engine lubricant) containing a nitrile compound of the invention provides resistance to lead corrosion.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A method of reducing lead corrosion of lead or lead alloy components in an internal combustion engine, said method comprising supplying to the internal combustion engine a lubricating composition comprising 46 to 97.9 wt %, of an oil of lubricating viscosity, from 0.1 to 0.5 wt % of a nitrile compound of formula (2):

formula (2)

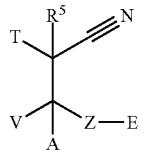

wherein, T is —C≡N; $R^5$ is hydrogen; V is a hydrocarbyl group containing 4 to 20 carbon atoms; Z is —S—; A is hydrogen; and E is a hydrocarbyl group containing 4 to 20 carbon atoms, and from 0.5 wt % to 1.5 wt % of zinc dialkyldithiophosphate, wherein the lubricating composition is characterised as having (i) a sulphur content of 0.5 wt % or less, (ii) a phosphorus content of 0.1 wt % or less, and (iii) a sulphated ash content of 1.5 wt % or less, and;

thereby reducing lead corrosion in said lead or lead alloy components.

2. The method of claim 1, wherein E is a $C_{6-12}$ linear alkyl group.

3. The method of claim 1 wherein the lubricating composition further comprises at least one of an antiwear agent, a dispersant viscosity modifier, a friction modifier, a viscosity modifier, an antioxidant, an overbased detergent, or mixtures thereof.

4. The method of claim 1 wherein the lubricating composition further comprises a dispersant viscosity modifier.

5. The method of claim 1 wherein said lead or lead alloy components are cam followers and bearings.

6. The method of claim 1 wherein said lubricating composition comprises 1.09 wt % zinc dialkyldithiophosphate and 0.1 wt % nitrile compound, based on a total weight of said lubricating composition.

7. The method of claim 1 wherein said nitrile compound comprises the reaction product of a malononitrile and a thiol.

8. The method of claim 7 wherein said nitrile compound comprises the reaction product of 2-ethylhexanylidene malononitrile and n-dodecylthiol.

* * * * *